US005465555A

United States Patent [19]

Morgan et al.

[11] Patent Number: 5,465,555

[45] Date of Patent: Nov. 14, 1995

[54] APPARATUS FOR PACKAGING GRANULAR MATERIAL

[75] Inventors: Gaylard M. Morgan, Saxton, Pa.; Anthony Malczanek, New York, N.Y.; Peter J. Gould, Greenwich, Conn.

[73] Assignee: Copack International Inc., Carlstadt, N.J.

[21] Appl. No.: 313,747

[22] Filed: Sep. 27, 1994

[51] Int. Cl.[6] ..... B65B 9/02

[52] U.S. Cl. ..... 53/451; 53/553; 53/554

[58] Field of Search ..... 53/451, 469, 546, 53/553, 554, 51, 389.3, 389.4, 560, 453, 559

[56] References Cited

U.S. PATENT DOCUMENTS

| | | | |
|---|---|---|---|
| Re. 25,839 | 8/1965 | Stroop | 53/546 |
| 2,765,605 | 10/1956 | Brelsford et al. | 53/554 |
| 2,827,742 | 3/1958 | Bursak | 53/546 |
| 2,878,630 | 3/1959 | Stirn et al. | 53/560 |
| 2,889,671 | 6/1959 | Weisman | 53/554 X |
| 3,633,331 | 4/1970 | Reichlin | 53/546 X |
| 3,641,737 | 2/1972 | Tamagni | 53/554 |
| 3,846,569 | 11/1974 | Kaplan | 53/546 X |
| 4,004,399 | 1/1977 | Borrello | 53/554 |
| 4,209,960 | 7/1980 | Deutschlander et al. . | |
| 4,215,524 | 8/1980 | Saylor | 53/554 |
| 4,437,294 | 3/1984 | Romagnoli . | |
| 4,571,924 | 2/1986 | Bahrani | 53/560 X |
| 4,631,905 | 12/1986 | Maloney . | |
| 4,722,168 | 2/1988 | Heaney | 53/51 X |
| 4,967,537 | 11/1990 | Moore . | |
| 5,067,306 | 11/1991 | Umezawa | 53/389.4 X |
| 5,134,835 | 8/1992 | Walkiewicz, Jr. et al. | 53/389.4 X |
| 5,154,037 | 10/1992 | Focke | 53/389.4 X |

*Primary Examiner*—Horace M. Culver
*Attorney, Agent, or Firm*—Klauber & Jackson

[57] ABSTRACT

An apparatus for packaging granular materials, wherein the granular material flows vertically through various components, wherein the apparatus comprises a frame, a plurality of servo driven packaging payout means, a plurality of packaging material alignment means, granular material filler means, sealing means, and severing means. The apparatus further comprises a computer controlled coordination means for controlling and coordinating the operations performed by the components of the apparatus.

42 Claims, 7 Drawing Sheets

APPARATUS FOR PACKAGING GRANULAR MATERIAL

FIELD OF INVENTION

This invention relates generally to the field of packaging and more specifically to the automated packaging of granular materials between two continuous sheets of packaging material so as to form individual packets. Examples of the materials which may be contained in these individual packets include tea, coffee, pharmaceutical products, soft drink powders, powder detergents, etc.

BACKGROUND OF THE INVENTION

Heretofore, various automated packaging machines have been known for packaging materials in packet form. Generally, these machines have been of the type where a freely unwinding continuous sheet of paper, foil, or the like is sealed along two edges leaving an open edge into which measured amounts of material are deposited. Thereafter, the open edge is sealed, usually by a smooth or serrated surfaced bar, and a severing operation is performed.

However, such an arrangement provides distinct disadvantages. In the first place, this arrangement results in the formation of rectangularly shaped packets. The rectangular shape requires double sealing. Three edges are sealed before filling, and the fourth edge is sealed after filling. This double sealing method is difficult to use if the desired shape of the packets is a shape other than rectangular, for example, circular. The use of such a double sealing method is also less efficient than a single sealing method. Another disadvantage is that the machines are not adaptable to readily change from producing a packet of one size and shape to a packet of a different shape or size without extensive retooling of the machine. Still another disadvantage is that packaging machines which operate horizontally require more factory floor space than those which operate vertically. A problem also results from the use of such an arrangement in that packaging material freely unwinds from a roll. The speed and tension of the unwinding packaging material cannot be controlled when permitted to freely unwind. This is particularly disadvantageous when there are two sheets of packaging material which must interface at a particular point. Also, freely unwinding packaging material cannot be stopped simultaneously when the machine is turned off. Lastly, there is a decrease in production output in the above mentioned arrangement because it is not designed to produce multiple horizontal rows, as well as multiple vertical rows of packets.

Accordingly, the aforementioned arrangement has presented distinct disadvantages in the automated packaging of granular materials.

Other arrangements have been developed in the area of automated packaging. For example, U.S. Pat. Nos. 3,633,331, 4,004,399, 4,209,960, 4,215,524, 4,437,294, 4,631,905, and 4,967,537 are all directed to various methods of automated packaging. A brief description of these methods is now given.

U.S. Pat. No. 3,633,331 to Reichlin discloses a rotating vane-type feeder for dispensing granular material between two webs of packaging material. The filling and sealing of the packages occurs at a sealing station.

U.S. Pat. No. 4,004,399 to Borrello discloses a form-fill-seal apparatus in which two webs of packaging material are united by rotating sealing nip rolls that provide a longitudinal seam forming a tube. Material is deposited into the tube by a rotating feeding vane. The tube is subsequently sealed transversely to provide discrete packets by nipping sealing surfaces.

U.S. Pat. No. 4,209,960 to Deutschlander et al. discloses an apparatus which weighs articles to form uniformly weighing stacks of articles that are subsequently packaged in cartons.

U.S. Pat. No. 4,215,524 to Saylor discloses the use of longitudinal seam forming nip rolls and transverse sealing means for forming a chain of packets from two webs of packaging material which is then cut by a separate cutter to form discrete packets.

U.S. Pat. No. 4,437,294 to Romagnoli discloses a two web form-fill-seal apparatus using a pocket roller dispensing fluent product on to one, horizontal, web and a pair of opposed pocketed rollers for placing another web over the material carrying web and forming and sealing the two webs into individual packets.

U.S. Pat. No. 4,631,905 to Maloney discloses a form-fill-seal apparatus in which two webs of packaging material are formed into packets by transverse and longitudinal seam forming nip rolls.

U.S. Pat. No. 4,967,537 to Moore discloses an apparatus for packaging wherein a plurality of sealed interconnected compartments are formed by sealing together two separate webs.

It should be noted that the citation of any reference herein should not be deemed an admission that such reference is available as prior art to the present invention.

SUMMARY OF THE INVENTION

The present invention is generally directed to a multimodular packaging line provided with a supervisory control and data acquisition (SCADA) system and particularly to an apparatus for forming packets containing granular materials. The apparatus is designed to conserve factory space, and is adaptable to form packets of various sizes and shapes.

Accordingly, the present invention provides an apparatus for the preparation of discrete sealed packets containing granular materials. The apparatus operates in essentially the vertical direction and comprises a frame, a plurality of positively driven packaging material payout means, a plurality of packaging material alignment means, sealing means, granular material filler means, and severing means. The apparatus further comprises a computer controlled coordination means.

The frame is fixed in any suitable manner so as to maintain the modular nature of the apparatus. The frame provides the support for the components through which materials flow in vertically downward and downstream directions.

Each positively driven packaging material payout means comprises a packaging material roll stand for rotatably supporting a roll of continuous web of a packaging material and a packaging material tension control means. The continuous web of packaging material may be any suitable material which is heat sealable or coated with a heat sensitive sealing agent. The packaging material roll stand may be free standing or connected to the frame by a packaging support rail for example. The packaging material tension control means cooperates with the packaging payout means driver to control the unwind speed and the tension of the continuous web of packaging material.

Each packaging material alignment means, which is mounted within the frame, comprises a drive means and a plurality of alignment rollers. The plurality of alignment rollers receive the web of packaging material from the drive means which receives and aligns the web of packaging material from the packaging material payout means.

The granular filler means, which is positioned medially with respect to the alignment rollers comprises a granular material reservoir and a plurality of movable granular material dispensing heads. The granular material reservoir may be partitioned to contain various granular materials. The granular material dispensing heads comprise rotatable impeller wheels which form a plurality of compartments in which a predetermined quantity of granular material is contained. Granular material is transported from the granular reservoir to each movable granular material dispensing head through a granular feed tube. The movable granular dispensing heads cooperate with the sealing means to simultaneously fill and seal packets of granular material.

The sealing means which is removably mounted in the frame, forms packets of granular material between opposed and aligned webs of packaging material from the alignment means. The sealing means comprises a pair of opposed sealing rollers. A hot oil circulating system passes through a first sealing roller providing the heat means required to seal opposed continuous webs of packaging material, which are heat sealable or have been coated with a heat sensitive sealing agent. A second sealing roller has a uniform surface which is coated with a resilient material. When packets of a differing shape are desired, the sealing means may be removed and replaced by another sealing means having a first sealing roller with cavities of another shape, size, or both.

The severing means is removably mounted to the frame in a position vertically downward and downstream with respect to the sealing rollers. A plurality of removable mounting blocks with cavities are mounted to a first severing roller. The cavities have cutting rims which extend above the surface of the corresponding mounting blocks. The mounting blocks may be removed and replaced to accommodate cavities of various shapes and sizes as well as to replace dulled cutting rims so as to ensure uniform cutting. The first severing roller and a second severing roller operate synchronously with the pair of sealing rollers.

As the continuous webs of packaging material, which are heat sealable or have been coated with a heat sensitive agent, are unwound from the driven packaging material rolls, they pass through the packaging material tension means and into the packaging material alignment means. The alignment means driver draws the packaging material from the tension means in order for it to pass over and between a series of alignment rollers. The packaging material travels downwardly to a position between the granular material filler means and the sealing means. A predetermined quantity of granular material is deposited by the movable granular material dispensing heads downwardly between two vertically positioned sheets of packaging material so as to rest within a cavity of the first sealing roller. Thus, packets containing granular materials are simultaneously filled and sealed. The capability of the apparatus to simultaneously fill and seal packets using cavities is essential in the formation of the non-rectangular packets, for example, arcular, triangular, octangular, etc., shaped packets. The sealing means is removable and replaceable by another sealing means when packets of a different shape are desired. The sheets of packets travel vertically downward from the dual sealing rollers to the severing means. A plurality of mounting blocks with cavities are mounted to the surface of the first severing roller. The packets rest in the cavities of the first severing roller. These cavities have a cutting rim so as to sever individual packets from the continuous web of packaging material when the first severing roller rotates and contacts the second severing roller having a uniform surface. The severing means is removable and replaceable by another severing means. When packets of a different shape are desired or the cutting rim dulls, the mounting block may be removed and replaced. The packets are ejected vertically downward from the cavities by an ejection means, and are transported from the severing means by a conveying means. The operations performed by the apparatus are coordinated by a computer controlled coordination means.

The present invention satisfies the need in the field of packaging for a cost effective and factory floor space efficient apparatus which forms packets of granular material of various shapes and sizes.

Accordingly, it is an object of the present invention to provide an apparatus for packaging granular materials that overcomes the aforementioned problems with the prior art.

More particularly, it is an object of the present invention to provide an apparatus for packaging granular materials which performs its operations vertically so as to minimize the amount of factory floor space needed, thereby resulting in a cost effective apparatus.

It is another object of the present invention to provide an apparatus for packaging granular materials in which the sealing means and the severing means are removable and replaceable by other sealing means and severing means so as to produce packets of various geometric forms.

It is still another object of the present invention to provide an apparatus for packaging granular materials in which the filling and sealing occurs essentially simultaneously.

It is a further object of the present invention to provide an apparatus for packaging granular materials in which the packaging material feed rollers are driven so as to simultaneously cease unwinding when the machine is stopped.

It is still a further object of the present invention to provide an apparatus for packaging granular materials in which the operations performed by the apparatus can be controlled and coordinated by a computer.

It is also an object of the present invention to utilize fuzzy logic in the control of an apparatus for packaging granular materials.

The above objects, as well as other objects, features, and advantages of the present invention will become readily apparent from the following detailed description thereof which is to be read in connection with the accompanying drawings.

BRIEF DESCRIPTION OF THE DRAWINGS

In order to facilitate a fuller understanding of the present invention, reference is now made to the appended drawings. These drawings should not be construed as limiting the present invention, but are intended to be exemplary only.

FIG. 3 is a side plan view of a packaging material alignment means used in the apparatus for packaging granular materials according to the present invention shown in

FIG. 1.

DETAILED DESCRIPTION OF A PREFERRED EMBODIMENT

Figure 1:
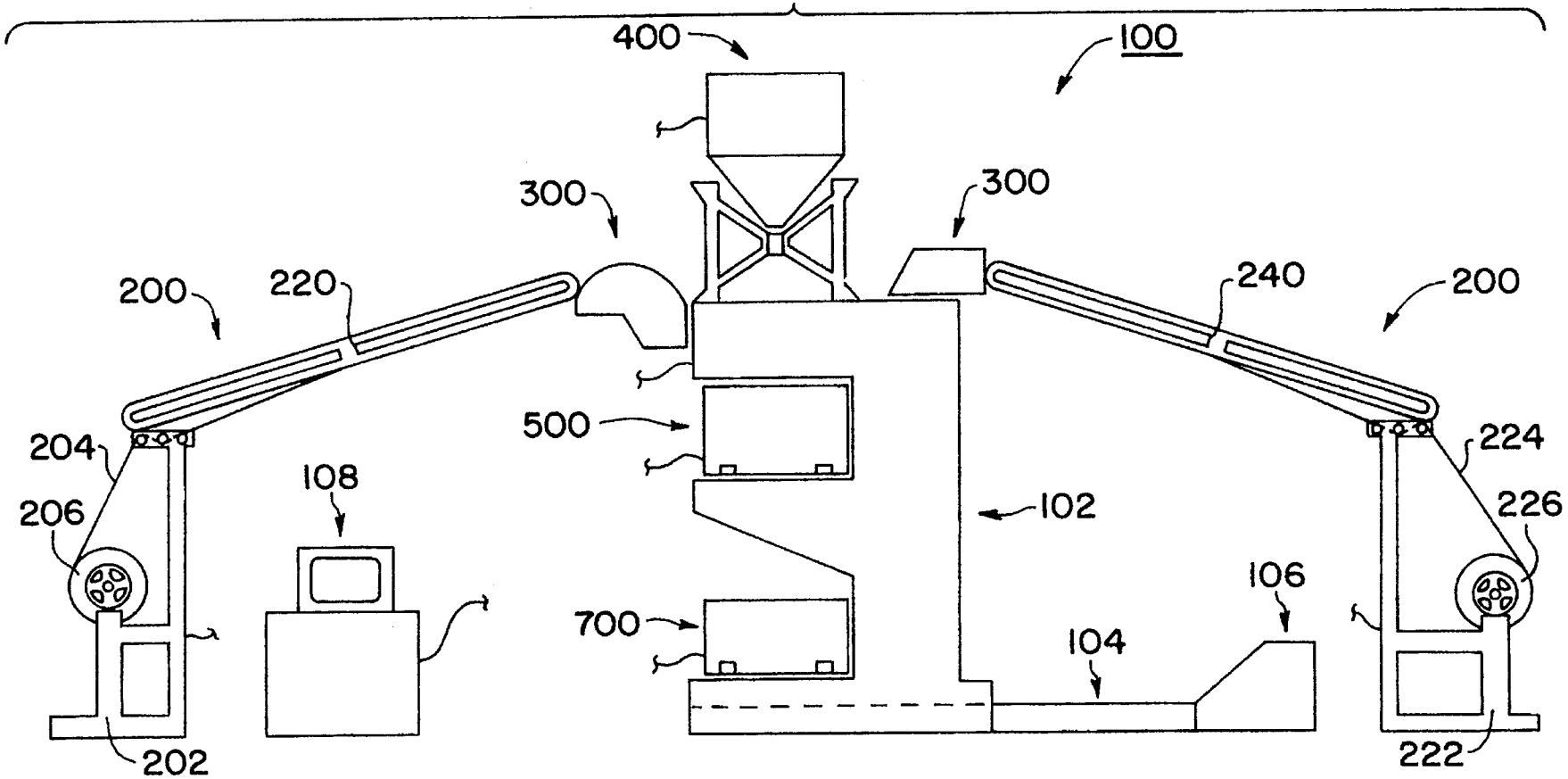
FIG. 1 is a side plan view of a preferred embodiment of an apparatus for packaging granular materials according to the present invention.

Referring to FIG. 1, there is illustrated a preferred embodiment of an apparatus 100 for packaging granular materials such as tea, coffee, pharmaceutical products, flavored soft drink granules, powdered detergents, to mention a few. The apparatus 100 is one module of a multimodular packaging line having a supervisory control and data acquisition (SCADA) system. The apparatus 100 for packaging granular materials operates essentially vertically and consists of a frame 102, first and second packaging material payout means 200, first and second packaging material alignment means 300, granular filling means 400, sealing means 500, severing means 700, conveying means 104, weighing means 106, and computer controlled coordination means 108.

The ability of the apparatus 100 to operate in the vertical direction is advantageous to a manufacturer. The cost of operating a machine is greatly reduced when it requires less factory floor space to operate. A vertically operating apparatus uses less factory floor space than an apparatus which operates horizontally.

As shown in FIG. 1, the apparatus 100 comprises a precision ground steel frame 102 which is fixed to the floor by any suitable means so as to permit sufficient support for the apparatus 100.

Connected to the frame 102 is a first packaging material roll stand 202 and a second packaging material roll stand 222. The stands 202,222 may be mounted to the frame 102, or they may be self standing and positioned near the frame 102. Each stand 202,222 must support an unwinding continuous web of packaging material as it rotates about a horizontal axis as well as permit for easy removal and replacement of packaging material rolls.

A first continuous web of packaging material 204 is fed from a first packaging material roll 206, and a second continuous web of packaging material 224 is fed from a second packaging material roll 226. The first packaging material roll 206 is mounted onto the first packaging material roll stand 202, and the second packaging material roll 226 is mounted onto the second packaging material roll stand 222. The packaging material rolls 206,226 may be mounted in any suitable manner, or they may be free standing in a manner which permits the rolls to rotate about a horizontal axis so as to unwind the respective packaging material 204,224. Additionally, the mounting must permit easy removal and replacement of the packaging material rolls 206,226. Examples of mountings include; bolting, riveting, air clamping, and mechanical clamping.

The sheets of packaging material 204,224 may be any suitable material, for example, filter paper, water soluble web, and metalized packaging material. Also, the sheets of packaging material 204,224 may be precoated with any non-toxic heat sensitive sealing agent which seals at a temperature in the range of ambient temperature to 650° F. Examples of non-toxic heat sensitive sealing agents include, polyethylene, polypropylene, and other suitable materials.

Figure 2:
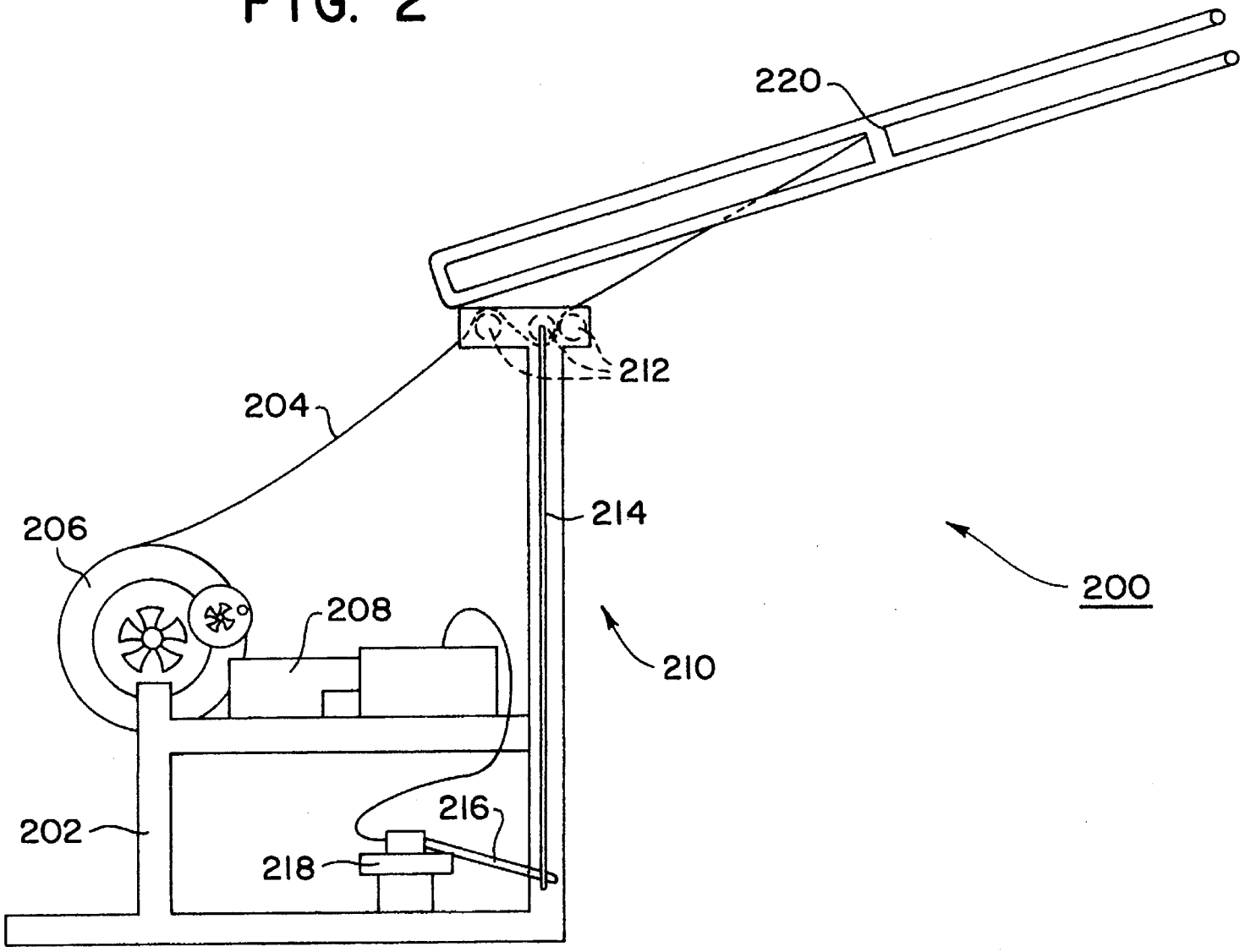
FIG. 2 is side plan view of a packaging material payout means used in the apparatus for packaging granular materials according to the present invention shown in FIG. 1.

Referring to FIG. 2, there is shown a detailed drawing of the first packaging material payout means 200, however, the description applies to the second packaging material payout means 200 as well. A packaging material roll driver 208 is mounted onto the packaging material roll stand 202 and positively drives the packaging material roll 206 so as to control the speed at which the web of packaging material 204 unwinds, as well as stop the unwind simultaneously with the stoppage of the whole apparatus 100.

In another embodiment of the present invention, one of the packaging material roll stands 202,222 is free standing as a component of a printing module, which is positioned adjacent to the apparatus 100 for packaging granular material. The packaging material roller in this other embodiment is positively driven. The web of packaging material passes through the printing module where information such as company name, product name, symbols, etc. is printed. The web of packaging material then feeds into the apparatus 100 for packaging granular material.

Referring again to FIG. 2, as the sheet of packaging material 204 unwinds, it passes through a packaging material tension control means 210 comprising a series of rollers 212 and a tension bar 214 connected to an air cylinder 216. The tension control means 210 has two purposes. It either causes a differential in the unwind speed of the first sheet packaging material 204, or it equalizes an existing differential unwind speed between the first sheet of packaging material 204 and the second sheet of packaging material 224. This control is important to ensure that the first and second sheets of packaging material 204,224 flow evenly since they must interface at both the filling means 400 and the sealing means 500. The tension of the packaging material 204 causes the tension bar 214 to rise or fall, thus causing the air cylinder 216 to react. A potentiometer 218, connected to the air cylinder 216, then sends a signal to the packaging material control means 208 to increase or decrease the speed of the unwind over or under the reference speed of a master drive motor. The sheet of packaging material 204 is supported by a packaging material support rail 220 as it is drawn into the alignment means 300 from the tension control means 210.

Figure 3:
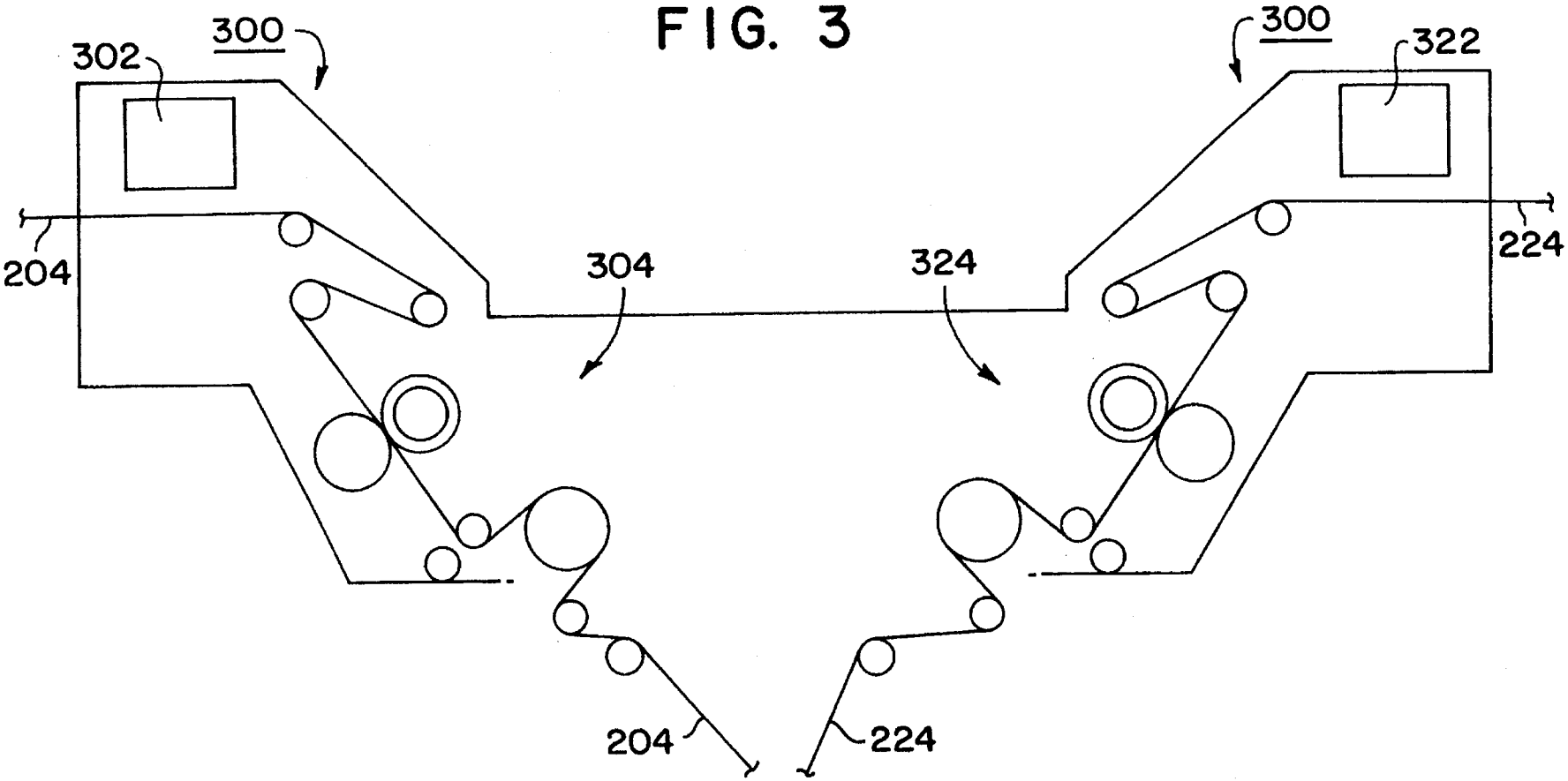

Referring to FIG. 3, the first and second packaging material alignment means 300 are shown. The first and second packaging material alignment means 300 are essentially identical, each having a motor 302,322, located on either side of the apparatus 100, for drawing the first and second webs of packaging material 204,224, respectively, into the respective alignment means 300. The motors 302, 322 control a first and a second set of alignment and transfer rollers 304,324, respectively. The first sheet of packaging material 204 passes over and between the first set of alignment and transfer rollers 304, which are mounted to the frame. The second sheet of packaging material 224 passes over and between the second set of alignment and transfer rollers 324, which are connected to the frame. The first and second continuous webs of packaging material 204,224 angularly exit the first and second set of alignment and transfer rollers 304,324, respectively, so as to interface at the sealing means 500. It should be noted that the alignment and transfer rollers 304,324 are electromechanically driven, which controls the first and second continuous webs of packaging material 204,224. This control is referenced off of the master drive motor and can be controlled to an accuracy of 1/100,000.

In another embodiment of the present invention, among the alignment and transfer rollers 304,324 is a heat generating lamp, for example, a quartz lamp. The heat generating lamp is used to preheat the continuous web of packaging material, which is heat sealable or coated with a heat sensitive sealing agent, prior to filling and sealing.

Figure 4:
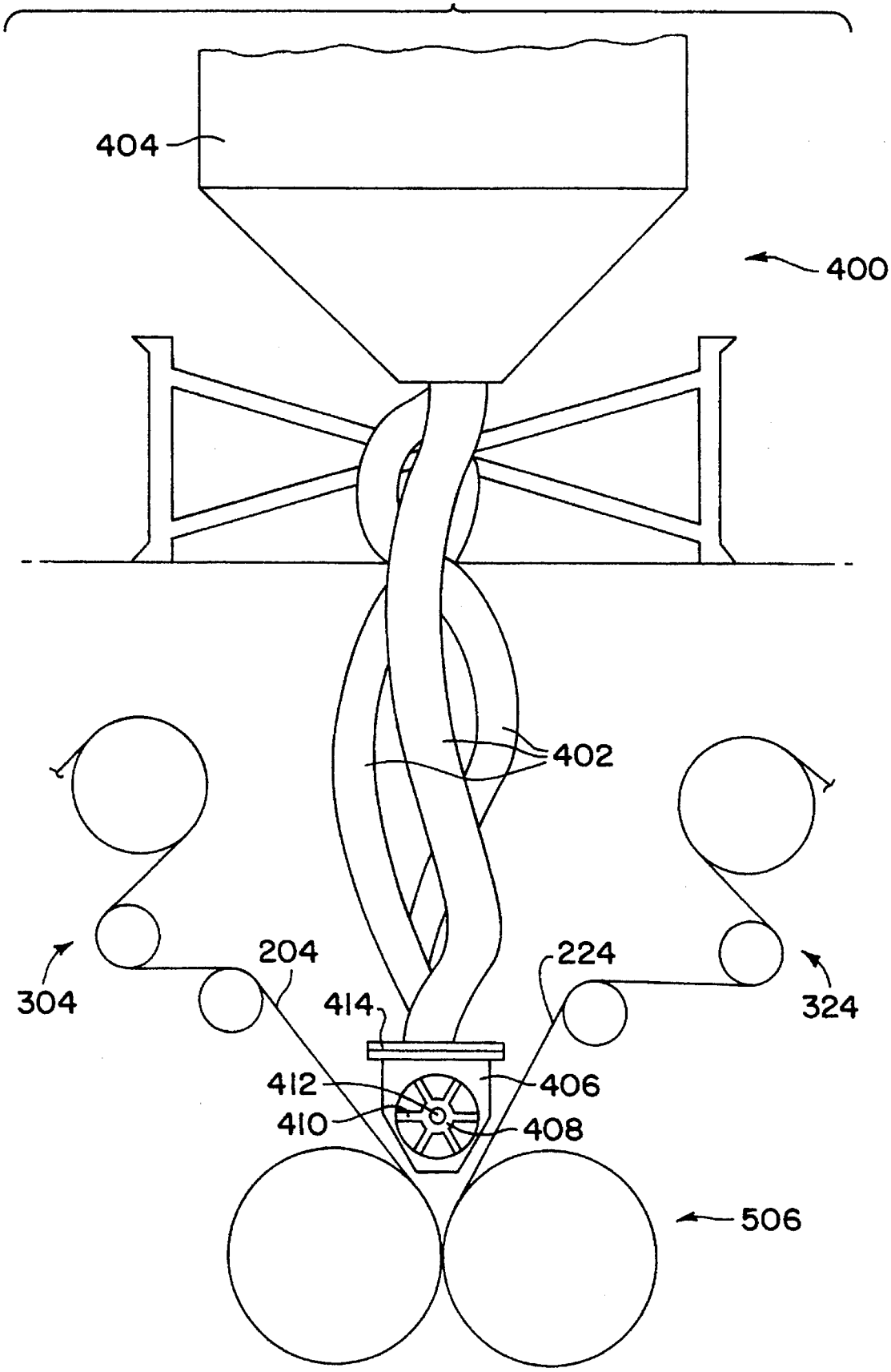
FIG. 4 is a side plan view of a granular filling means used in the apparatus for packaging granular materials according to the present invention shown in FIG. 1.

Referring to FIG. 4, the granular filling means 400 is shown wherein granular material travels through the granular filler means 400 and between the first and second set of alignment and transfer rollers 304,324. A plurality of granular material feed tubes 402 transport the granular material from a granular material reservoir 404 to a plurality of granular material dispensing heads 406. The granular material feed tubes 402 are hollow, with open top and bottom ends. The inner diameter of the granular material feed tubes 402 is in the range of 1 to 5 inches and the outer diameter of the granular material feed tubes 402 is in the range of 1.5 to 5.5 inches. The number of granular material feed tubes 402 is equal to the quantity of packets to be formed horizontally across the sheets of packaging material 204, 224. The top end of each granular material feed tube 402 is connected to the granular reservoir 404. The bottom end of each granular material feed tube 402 is connected to a corresponding granular material dispensing head 406.

The granular reservoir 404 may be constructed of any suitable material and be of any suitable shape or size. The granular material reservoir 404 may be partitioned in order to permit different granular materials to be stored and subsequently dispensed without mixing.

Each of the plurality of granular material dispensing heads 406 has a rotatable impeller device 408 which has a plurality of rib-like extensions 410 extending radially outward from a center axis 412. The number of granular material dispensing heads 406 is equal to the number of granular material feed tubes 402. In a preferred embodiment, the granular material dispensing heads 406 are mounted to a common mounting plate 414 along a horizontal axis. Between the rib-like extensions 410 a compartment is created for containing a predetermined quantity of granular material. This predetermined quantity of granular material is deposited between the first and second sheets of packaging material 204,224.

The granular material dispensing heads 406 are retractable so as to create clearance for a pair of sealing rollers 506 in the sealing means 500 to be removed and replaced. When the granular material dispensing heads 406 are in the filling position, they are positioned immediately above the pair of sealing rollers 506.

As shown in FIG. 4, the first and second continuous webs of packaging material 204,224 come together at a point immediately below the granular material dispensing heads 406 and immediately above the pair of sealing rollers 506.

Figure 5:
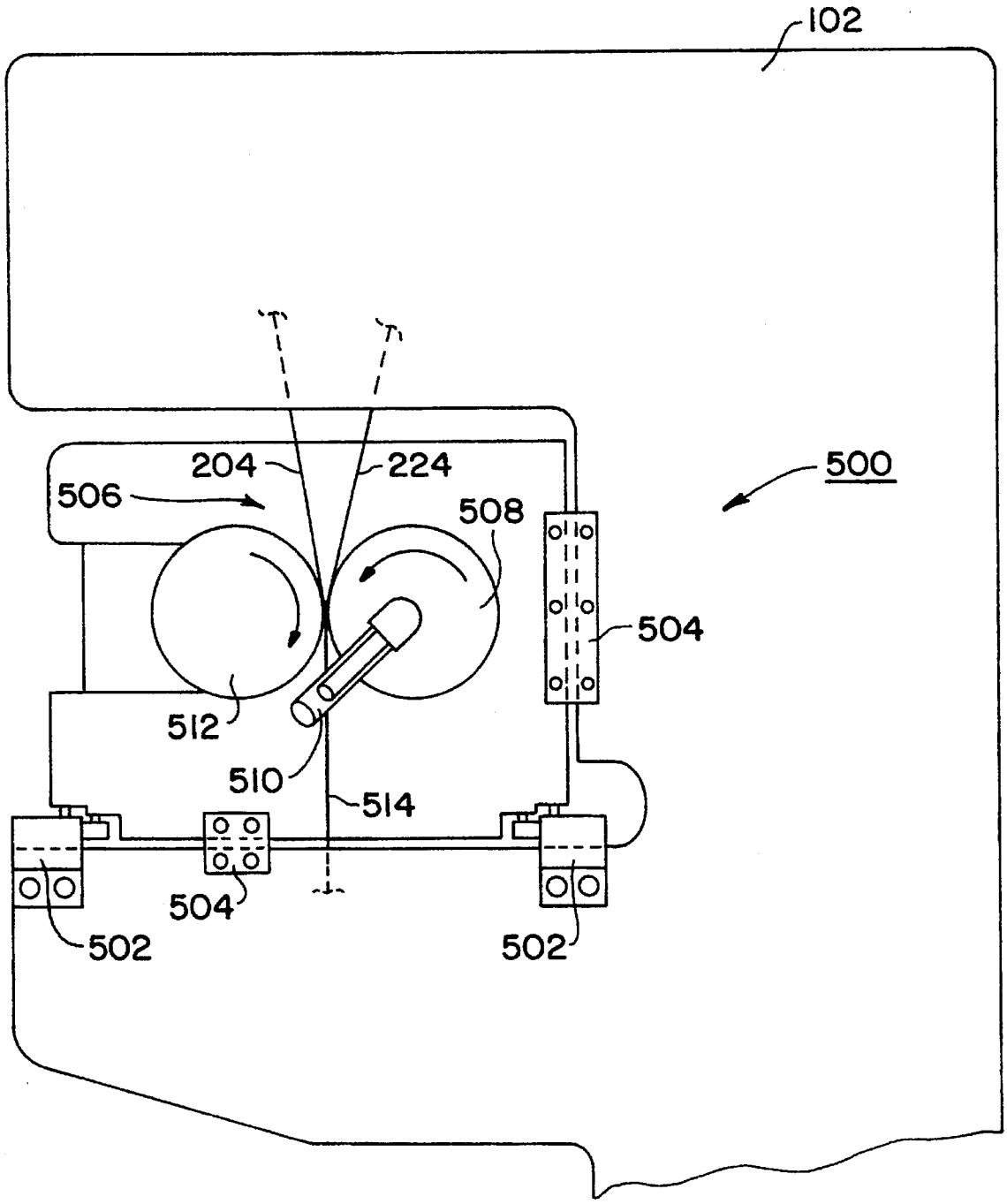
FIG. 5 is a side plan view of a sealing means used in the apparatus for packaging granular materials according to the present invention shown in FIG. 1.

Referring to FIG. 5, the sealing means 500 is shown slidably inserted into the frame 102 using four bearings 502 so as to be easily removed and replaced. In a preferred embodiment, removal and insertion of the sealing means 500 is along two guide tracks in a direction parallel to the axis of rotation of the sealing rollers 506. The sealing means 500 is mounted by two mounting plates 504. The sealing means 500 comprises the pair of sealing rollers 506 which rotate in opposite directions about a horizontal axis, as shown. The sealing rollers 506 are positioned so as to permit the rollers to be in pressure contact with each other. The sealing rollers 506 are separated and contacted by hydraulic means (not shown).

Figure 6:
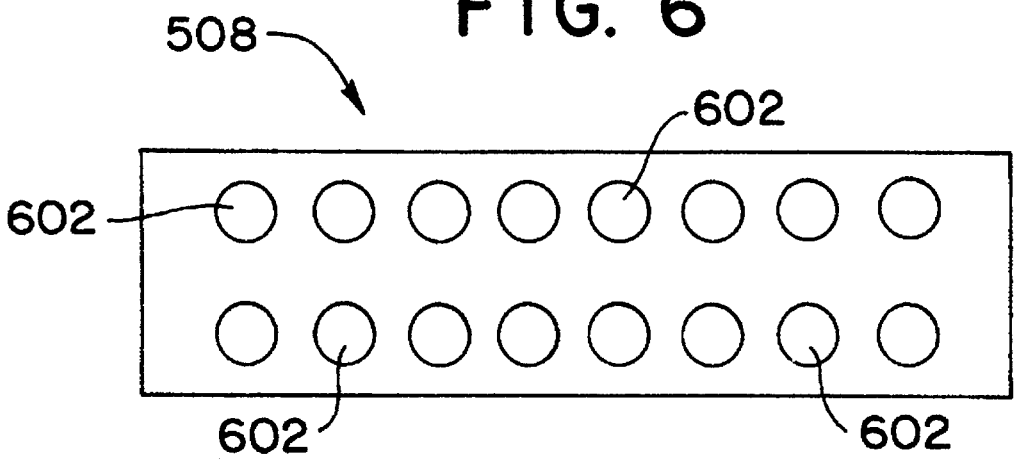
FIG. 6 is a front view of the first sealing roller in the sealing means shown in FIG. 5.

A first sealing roller 508 comprises a hollow shaft having a maximum inner diameter of 8 inches and a maximum outer diameter of 10 inches made of any suitable material such as metal or ceramic. Referring to FIG. 6, a front view of the first sealing roller 508 is shown revealing the sealing surface thereof having machined therein a plurality of concave recesses or cavities 602 in rows. In a preferred embodiment, the number of recesses or cavities 602 in a row is equal to the number of granular material dispensing heads 406 and corresponding granular material feed tubes 402. The shape and size of each recess or cavity 602 determines the size and shape of the finished packaged product. Examples of shapes of recesses or cavities 602 include both rectangular and non-rectangular configurations.

Referring again to FIG. 5, the first sealing roller 508 is provided with a hot oil circulating system 510 for heating the first sealing roller 508 during the sealing operation. The hot oil circulating system 510 has an electrically fired boiler, piping, insulation and a plurality of rotating unions. The rotating unions are designed so as to have a supply and return in a single union. The oil may be any suitable oil such as EXXON CALORIANT T-33 which is heated to a temperature in the range of just above ambient to 700° F. by the electrically fired boiler. The temperature of the first sealing roller 508 is controlled via feedback from infrared sensors.

A second sealing roller 512 is solid and may be made of any suitable material such as metal or ceramic. The second sealing roller 512 has a uniform surface which is coated with rubber having a thickness in the range of 0.250 to 1.000 inches. A coating of teflon having a thickness in the range of 0.010 to 0.050 inches is applied over the rubber coating. The coatings provide a resilient surface for supporting the sheets of packaging material 204,224 when sealing occurs. Alternatively, a mixture of rubber and teflon may be used on the second sealing roller 512. It should be noted that, when the second sealing roller 512 is made of a ceramic material, the surface may not be coated with rubber and teflon.

The ability to remove the sealing means 500 permits packets of different shapes and sizes to be formed since the sealing means 500 may be removed and replaced with a different sealing means 500 in which the first sealing roller 508 has cavities of an alternate configuration.

In another embodiment of the invention, the first sealing roller 508 may be machined so as to have cavities of varying shapes, sizes, or both on the same roller. It should be noted, however, that, in a preferred embodiment, the packets have an arcuate shape.

In operation, the granular material dispenser head 406, shown in FIG. 4, deposits a predetermined quantity of granular material between the first and second sheets of packaging material 204,224 as the first sealing roller 508 and the second sealing roller 512 rotate. The first and second sheets of packaging material 204,224, which are precoated with a nontoxic heat sensitive agent, are then sealed together where contacted by the heated first sealing roller 508, sandwiching the granular material therebetween. After the first and second sheets of packaging material 204,224 are sealed together, a continuous sheet 514 of rows of sealed granular material packets travel vertically downward to the severing means 700.

Figure 7:
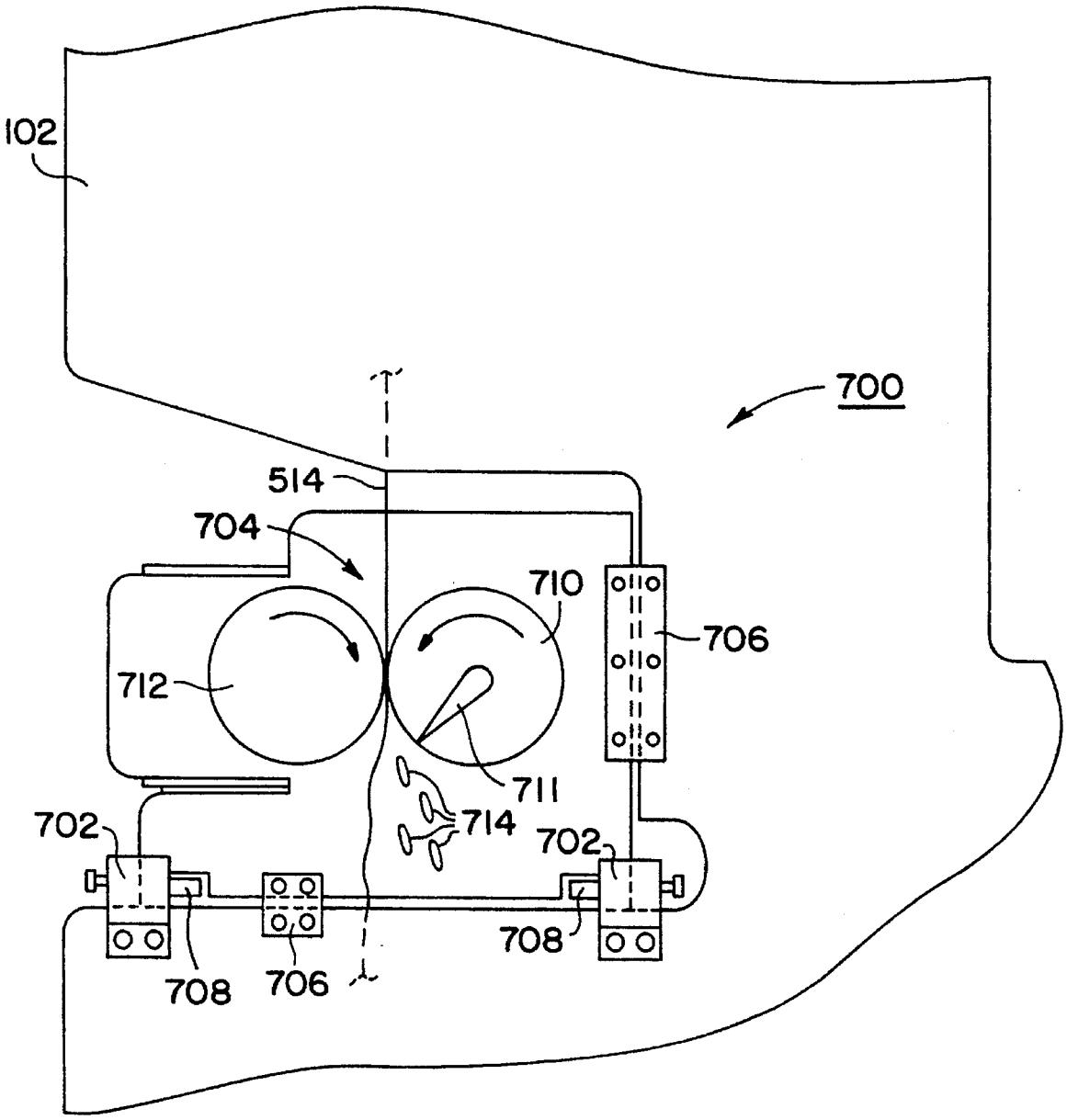
FIG. 7 is a side plan view of a severing means used in the apparatus for packaging granular materials according to the present invention shown in FIG. 1.

Referring to FIG. 7, the severing means 700 is shown slidably inserted into the frame 102 using four bearings 702 so as to be easily removed and replaced. In a preferred embodiment, removal and insertion of the severing means 700 is along two guide tracks in a direction parallel to the axis of rotation of a pair of severing rollers 704. The severing means 700 is mounted to the frame 102 by two mounting plates 706 and two sets of alignment pins 708. The severing means 700 comprises the pair of severing rollers 704 which rotate in opposite directions about a horizontal axis, as shown. The severing rollers 704 are positioned so as to permit the rollers to be pressure contact with each other. The severing rollers 704 are separated and contacted by mechanical means (not shown).

A first severing roller 710 comprises a hollow shaft surrounded by a sleeve. The hollow shaft and the sleeve may be made of any suitable material such as metal or ceramic. In a preferred embodiment, the hollow shaft is made of unhardened steel and the sleeve is made of hardened steel, for example of 50 Rockwell on the C scale.

Figure 8:
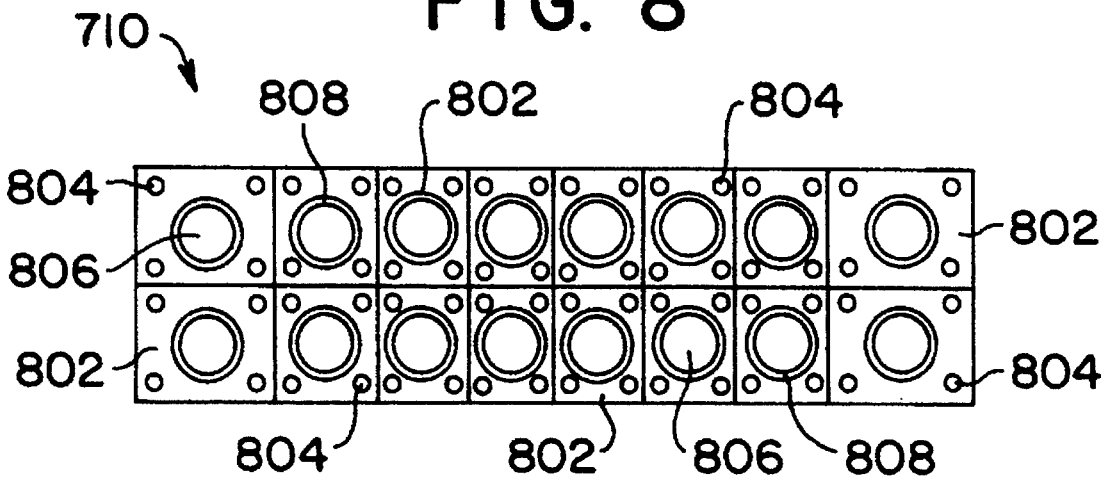
FIG. 8 is a front view of the first severing roller in the severing means shown in FIG. 7.

Referring to FIG. 8, a front view of the first severing roller 710 is shown revealing the sleeve which comprises a plurality of individual removable blocks 802 which are mounted to the hollow shaft of the first severing roller 710 by four mounting screws 804. Each block 802 is configured so as to be accommodated by the first severing roller 710 such that when all of the blocks 802 are mounted to the first severing roll 710 the cylindrical shape is maintained. Also, each block 802 has a cavity 806 and a cutting rim 808 formed therein. Each cutting rim 808 protrudes a suitable distance above the surface of its associated block 802 so as to insure uniform cutting. When a cutting rim 808 dulls, its corresponding block 802 is removed and replaced. This ability to remove and replace a block 802, or more appropriately a cutting rim 808, insures accurate and complete cuts of the continuous sheet of packaging material 514 over a long machine life. In another embodiment of the invention, the first severing roller 710 may be machined as one piece having a plurality of cavities.

Referring again to FIG. 7, the hollow shaft of the first severing roller 710 is provided with ejection means 711 for ejecting individual packets of granular material 714 from the cavities 806. The ejection means 711 may be of any suitable form such as a mechanical ejection means, a foam gasket material within each cavity 806, or an air blowing system.

A second severing roller 712 is solid and may be made of any suitable material such as metal or ceramic. In a preferred embodiment, the second severing roller 712 is made of hardened steel, for example of 65 Rockwell on the C scale. The second severing roller 712 acts as an anvil for each cutting rim 808 of the first severing roller 710. Thus, it is important to make the second severing roller 712 from a material having a hardness that is greater than that of the first severing roller 710 so as to insure that wear occurs on the first severing roller 710.

The speed of the pair of severing rollers 704 is controlled by a servo drive motor based on the speed of the pair of sealing rollers 506.

In operation, the continuous sheet 514 of rows of sealed granular material packets passes between the pair of rotating severing rollers 704. The first severing roller 710 severs the continuous sheet of packaging material 514 so as to create individual packets of granular material 714. Any excess packaging material is removed from the apparatus 100. The individual packets of granular material 714 are removed from the cavities 806 of the first severing roller 710 by the ejection means 711. The ejected packets 714 travel in a vertically downward direction to the conveying means 104 which transports the packets 714 to the weighing means 106, as shown in FIG. 1. In a preferred embodiment, the conveying means 104 comprises a conveyor belt which is continuously driven.

The various servo drive means which operate within the apparatus 100 are coordinated by the computer controlled coordination means 108. The computer controlled coordination means 108 provides two way "communication" between an operator and the apparatus 100 and provides error diagnostic capabilities at each level. This is done over a redundant distributed network using controlled loop programs, as well as direct input and logic ladders, to provide total control via fuzzy logic theory. The operator can provide information and instructions to the apparatus 100, for example, a specific station may be provided with operating parameters. In addition, the apparatus 100 can send information to the operator so that operations performed at various stations within the apparatus 100 can be coordinated, for example, feedback from the packaging material payout means 200 regarding certain operating parameters provides the computer controlled coordination means 108 with information needed to coordinate other operations such as the sealing means 400.

The computer controlled coordination means 108 also controls the various drive means within the apparatus 100 with a fuzzy logic control algorithm. The fuzzy logic control algorithm allows the computer controlled coordination means 108 to make reasonable adjustments to the various drive means within the apparatus 100 independent of the operator. Such adjustments are typically made in response to situations, which are uncertain and/or imprecise in nature, that would normally require input from or an intelligent decision to be made by the operator. Examples of such situations include variations in the quality of the packaging material, dust or material quantity build-up in the apparatus 100, and humidity or temperature variations in the environment of the apparatus 100.

OPERATION

With the various components of the apparatus 100 now described, a brief description of the operation of the apparatus 100 will now be given.

The various components of the apparatus 100 are moved into their respective operating positions prior to the start of production. Using four air cylinders the sealing rollers 506, which are components of the sealing means 500, are positioned so as to be in pressure contact. The severing rollers 704, which are components of the severing means 700, are positioned so as to be in pressure contact by use of mechanical means. When the sealing rollers 506 are in their operating positions, the movable granular material dispensing heads 406, which are components of the granular material filling means 400, are dropped into position so as to be located immediately above the sealing rollers 506.

Once the various components of the apparatus 100 are in their operating positions, a continuous web of packaging material 204,224 begins to unwind from each of the driven dual rolls of packaging material 206,226. The packaging material 204,224 is heat sealable or precoated with a heat sensitive sealing agent. The packaging material rolls 206, 226 are mounted onto first and second packaging material roll stands 202,222. The dual packaging material rolls 206, 226 and dual packaging material roll stands 202,222 are components of the driven packaging material payout means 200 as shown in FIG. 1 and 2.

Each of the unwound webs of packaging material 204,224 enter a tension control means 210 which comprises a series of rollers 212, an air cylinder 216, a tension bar 214, and a potentiometer 218 as seen in FIG. 2. Tension from the webs 204,224 cause the tension bar 214 to rise or fall which causes the air cylinder 216 to react. The potentiometer 218 sends a signal to the packaging material control means 208 to increase or decrease the speed of the unwind as referenced to the reference speed of the master drive motor. This speed increase or decrease either causes or equalizes a differential in the unwind speeds of the two webs 204,224 and controls the tension of the webs 204,224 to within 0.1 pound per linear inch.

Each alignment means 300 comprises a motor 302,322 which draws a continuous web of packaging material 204, 224 over a packaging material support rail 220,240 which connects the packaging material payout means 200 to the frame 102 of the apparatus 100 as seen in FIG. 1. The webs 204,224 enter the frame 102 of the apparatus 100 traveling over and between a plurality of alignment and transfer rollers 304,324. The webs of material 204,224 exit the alignment and transfer rollers 304,324 at an angle in a downwardly direction, as seen in FIG. 3, so as to interface at the sealing means 500.

Simultaneously, with respect to the travel of the two continuous webs of packaging material 204,224, granular material travels downwardly within the granular filler means 400 from a granular reservoir 404 to a plurality of granular material dispensing heads 406 mounted immediately above the sealing means 500 via a plurality of granular material feed tubes 402. The granular filler means 400 is shown in FIG. 4. The granular material feed tubes 402 are positioned medially with respect to the alignment and transfer rollers 304,324. Granular material drops from each feed tube 402 into a corresponding dispensing head 406 where it is contained in one of a plurality of compartments formed between the rib-like extensions 410 of each dispensing head 406.

A predetermined amount of granular material, controlled by a closed loop provided by a scale unit, is deposited by each dispensing head 406 between the continuous webs of packaging material 204,224 where they interface at the sealing means 500 so as to fill and seal the packets at essentially the same time. The sealing means 500 is shown in FIG. 5. As the sealing rollers 506 rotate, the granular material drops into a position adjacent one of a plurality of cavities 602 formed on the first sealing roller 508, as shown in FIG. 6. Packets are formed when the webs 204,224 sandwiching the granular material are sealed together upon contact with the heated first roller 508.

The continuous sheet of formed packets 514 travels in a downward direction to the severing means 700, which is shown in FIG. 8. The packets rest within cavities 806 on the first severing roller 710 and are separated from each other by cutting rims 808 located around the perimeter of the cavities 806, which extend above the surface of the first severing roller 710, as shown in FIG. 7. The rotational speed of the severing rollers 704 is determined by the speed at which the sealing rollers 506 rotate by use of a servo-motor.

The severed packets 714 are ejected from the cavities 806 of the first severing roller 710 by an ejection means 711 and are transported by a conveying means 104 to a weighing means 106, as shown in FIG. 1.

The computer controlled coordination means 108 controls and coordinates the various operations performed by the apparatus 100. For example, if the unwind speed of the packaging material 204,224 is increased or decreased by the tension control means 210, the computer controlled coordination means 108 automatically adjusts the speed of the motor which causes the sealing rollers 506 to rotate.

This adjustment is communicated to the other motors in the apparatus 100 which are then adjusted accordingly; for example, the speed at which the severing rollers 704 rotate is adjusted accordingly. Furthermore, a fuzzy logic control algorithm allows the computer controlled coordination means 108 to make adjustments to the various components of the apparatus 100 which are typically made in response to situations, which are uncertain and/or imprecise in nature, that would normally require input from or an intelligent decision to be made by the operator.

The present invention is not to be limited in scope by the specific embodiments described herein. Indeed, various modifications of the invention, in addition to those described herein, will be apparent to those of skill in the art from the foregoing description and accompanying drawings. Thus, such modifications are intended to fall within the scope of the appended claims. Additionally, various references are cited throughout the specification, the disclosures of which are each incorporated herein by reference in their entirety.

What is claimed is:

1. An apparatus for packaging granular materials, said apparatus comprising:

a frame adapted to support assemblies for the sequential packaging of granular materials in the vertical direction;

a plurality of positively driven packaging material payout means, each said positively driven packaging material payout means comprising a packaging material roll stand for rotatably supporting a roll of a continuous web of packaging material and a packaging material tension control means for controlling the tension of an unwound portion of said continuous web of packaging material;

a plurality of packaging material alignment means mounted within said frame, each said packaging material alignment means being associated with a corresponding one of said plurality of positively driven packaging material payout means, each said packaging material alignment means comprising a plurality of alignment and transfer rollers for receiving said continuous web of packaging material from said corresponding positively driven packaging material payout means and aligning the same with at least one other said continuous web of packaging material from another of said packaging material alignment means;

granular material filler means positioned medially between said plurality of packaging material alignment means, said granular material filler means comprising a granular material reservoir and a plurality of granular material dispensing heads for depositing granular material at designated locations between said aligned continuous webs of packaging material;

sealing means removably mounted within said frame, said sealing means comprising a pair of opposed sealing rollers for sealing together said aligned continuous webs of packaging material outside of said designated locations; and severing means removably mounted within said frame vertically downward and downstream with respect to said sealing means, said severing means comprising a pair of opposed severing rollers, operating synchronously with said pair of sealing rollers, for severing individual packets of granular material from said sealed continuous webs of packaging material.

2. The apparatus as defined in claim 1, wherein said apparatus further comprises a computer controlled coordination means for controlling and coordinating the operation of said apparatus.

3. The apparatus as defined in claim 2, wherein said computer controlled coordination means utilizes fuzzy logic to control and coordinate the operation of said apparatus.

4. The apparatus as defined in claim 2, wherein said frame is fixed in position.

5. The apparatus as defined in claim 2, wherein said packaging material roll stand is connected to said frame by a packaging material support rail.

6. The apparatus as defined in claim 2, wherein said packaging material roll stand is free standing.

7. The apparatus as defined in claim 2, wherein said positively driven packaging material payout means further comprises a packaging material roll driver for unwinding said roll of a continuous web of packaging material.

8. The apparatus as defined in claim 7, wherein the packaging material roll driver is mounted to said packaging material roll stand.

9. The apparatus as defined in claim 7, wherein said packaging material roll driver operates in cooperation with said packaging material tension control means and said roll of a continuous web of packaging material.

10. The apparatus as defined in claim 2, wherein said packaging material tension control means is mounted to said packaging material roll stand.

11. The apparatus as defined in claim 2, wherein said packaging material tension control means comprises a plurality of rollers, an air cylinder, a tension bar, and a potentiometer.

12. The apparatus as defined in claim 2, wherein said granular material filler means further comprises a plurality granular material feed tubes for transporting granular material from said granular material reservoir to said plurality of granular material dispensing heads.

13. The apparatus as defined in claim 2, wherein said granular material reservoir is a storage bin.

14. The apparatus as defined in claim 2, wherein said granular material reservoir is partitioned.

15. The apparatus as defined in claim 2, wherein the granular material reservoir is mounted to said frame.

16. The apparatus as defined in claim 2, wherein each of said plurality of granular material dispensing heads comprises an impeller wheel for forming a plurality of compartments for dispensing a predetermined quantity of granular material.

17. The apparatus as defined in claim 2, wherein said sealing means is removably inserted into the frame on four ball bearings over a guide rail and mounted to said frame with a mounting plate.

18. The apparatus as defined in claim 2, wherein said pair of opposed sealing rollers rotate in opposite directions about a horizontal axis.

19. The apparatus as defined in claim 2, wherein said pair of opposed sealing rollers are in pressure contact.

20. The apparatus as defined in claim 2, wherein said sealing means comprises a hollow first sealing roller, having a plurality of cavities formed on the outer surface thereof corresponding to said designated locations and a heating means contained therewithin, and a second sealing roller having a uniform surface.

21. The apparatus as defined in claim 20, wherein said heating means comprises a hot oil circulating system for maintaining the outer surface of said first sealing roller at a temperature sufficient to cause the sealing together of said aligned continuous webs of packaging material.

22. The apparatus as defined in claim 20, wherein said second sealing roller comprises a solid shaft that is coated with a resilient material.

23. The apparatus as defined in claim 22, wherein said resilient material is rubber.

24. The apparatus as defined in claim 22, wherein said resilient material is teflon.

25. The apparatus as defined in claim 2, wherein said severing means is removably inserted into said frame on four ball bearings over a guide rail, and wherein said severing means is mounted to said frame by two alignment pins and a mounting plate.

26. The apparatus as defined in claim 2, wherein said pair of opposed severing rollers rotate in opposite directions about a horizontal axis.

27. The apparatus as defined in claim 2, wherein said pair of opposed severing rollers are in pressure contact.

28. The apparatus as defined in claim 2, wherein said severing means comprises a hollow first severing roller, having a plurality of removable blocks mounted to the outer surface thereof and an ejection means contained therewithin, and a second severing roller having a uniform surface.

29. The apparatus as defined in claim 28, wherein said each of said plurality of removable blocks has a cavity and a cutting rim formed therein, wherein said cutting rim surrounds said cavity and said cutting rim protrudes above the surface of said removable block.

30. The apparatus as defined in claim 2, wherein said severing means comprises a hollow first severing roller, having a plurality of cavities and cutting rims formed on the outer surface thereof and an ejection means contained therewithin, and a second severing roller having a uniform surface.

31. The apparatus as defined in claim 30, wherein each said cutting rim surrounds one of said cavities and each said cutting rim protrudes above the surface of said hollow first severing roller.

32. The apparatus as defined in claim 2, wherein said apparatus further comprises:

weighing means for weighing said individual packets granular material; and conveying means for transporting said individual packets granular material forms said severing means to said weighing means.

33. The apparatus as defined in claim 2, wherein said apparatus further comprises heating means for heating a first of said pair of opposed sealing rollers so as to facilitate sealing together said aligned continuous webs of packaging material.

34. The apparatus as defined in claim 33, wherein said heating means comprises a hot oil circulating system for maintaining the outer surface of said first sealing roller at a temperature sufficient to cause the sealing together of said aligned continuous webs of packaging material.

35. The apparatus as defined in claim 2, wherein said apparatus further comprises ejection means for ejecting said individual packets of granular material from said severing means.

36. A method for packaging granular materials, said method comprising:

rotatably supporting a plurality of rolls of a continuous web of packaging material;

controlling the tension of an unwound portion of said continuous web of packaging material from each of said plurality of rolls;

aligning said unwound portion of said continuous web of packaging material from each of said plurality of rolls with at least one other said unwound portion of said continuous web of packaging material from another of said plurality of rolls;

depositing granular material at designated locations between said aligned continuous webs of packaging material from said plurality of rolls;

sealing together said aligned continuous webs of packaging material from said plurality of rolls outside of said designated locations; and severing individual packets of granular material from said sealed continuous webs of packaging material from said plurality of rolls.

37. The method as defined in claim 36, wherein said method further comprises the step of controlling and coordinating the steps of said method utilizing fuzzy logic.

38. The method as defined in claim 36, wherein said method further comprises the step of weighing said individual packets granular material.

39. The method as defined in claim 36, wherein said method further comprises the step of heating said aligned continuous webs of packaging material from said plurality of rolls so as to facilitate sealing together said aligned continuous webs of packaging material from said plurality of rolls.

40. The method as defined in claim 36, wherein said step of severing individual packets of granular material comprises severing said sealed continuous webs of packaging material from said plurality of rolls outside each of said designated locations.

41. The method as defined in claim 36, wherein said method further comprises the step of separating said individual packets of granular material from remaining portions of said sealed continuous webs of packaging material from said plurality of rolls.

42. The method as defined in claim 41, wherein said step of separating said individual packets of granular material from remaining portions of said sealed continuous webs of packaging material comprises ejecting said individual packets of granular material away from said remaining portions of said sealed continuous webs of packaging material from said plurality of rolls.

* * * * *